US006672375B1

(12) United States Patent
Shippy et al.

(10) Patent No.: US 6,672,375 B1
(45) Date of Patent: Jan. 6, 2004

(54) FIN TUBE HEAT EXCHANGER WITH DIVERGENT TUBE ROWS

(75) Inventors: Glen F. Shippy, Clarksville, TN (US); Jeffrey C. Marks, Clarksville, TN (US); Allen E. Swaw, Southside, TN (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/189,973

(22) Filed: Jul. 2, 2002

(51) Int. Cl.[7] ..... F28D 1/04
(52) U.S. Cl. ..... 165/151; 165/122
(58) Field of Search ..... 165/150, 151, 165/122

(56) References Cited

U.S. PATENT DOCUMENTS 4,173,998 A * 11/1979 Jahoda ..... 165/182
4,241,785 A * 12/1980 O'Connor et al. ..... 165/172
4,475,585 A * 10/1984 Hoeffken ..... 165/134
5,056,594 A 10/1991 Kraay
5,267,610 A * 12/1993 Culbert ..... 165/151
5,954,125 A * 9/1999 Mantegazza et al. ..... 165/150

FOREIGN PATENT DOCUMENTS

JP 2-298796 A * 12/1990 ..... 165/151

OTHER PUBLICATIONS

B. Checket–Hanks, Air Conditioning, Heating, Refrigeration News, "Contractor Wish List Yields New Coil Design", Dec. 17, 2001.
"3 to 5 Ton Light Commercial Convertible Packaged Air Conditioners", Pub. No. 13–7014–00, 2001.

* cited by examiner

*Primary Examiner*—Terrell McKinnon
(74) *Attorney, Agent, or Firm*—William J. Beres; William O'Driscoll

(57) ABSTRACT

A fin tube heat exchanger. The fin tube heat exchanger comprises: a first tube row including a plurality of tubes; and a second tube row including a second plurality of tubes. The first and second tube rows includes a slab portion respectively in contiguous parallel relation with the counterpart slab portion of the other tube row. Each of the first and second tube rows includes a respective first and second spread portion wherein the first and second spread portions are in diverging non-contacting relation with respect to each other.

25 Claims, 2 Drawing Sheets

FIG. 1
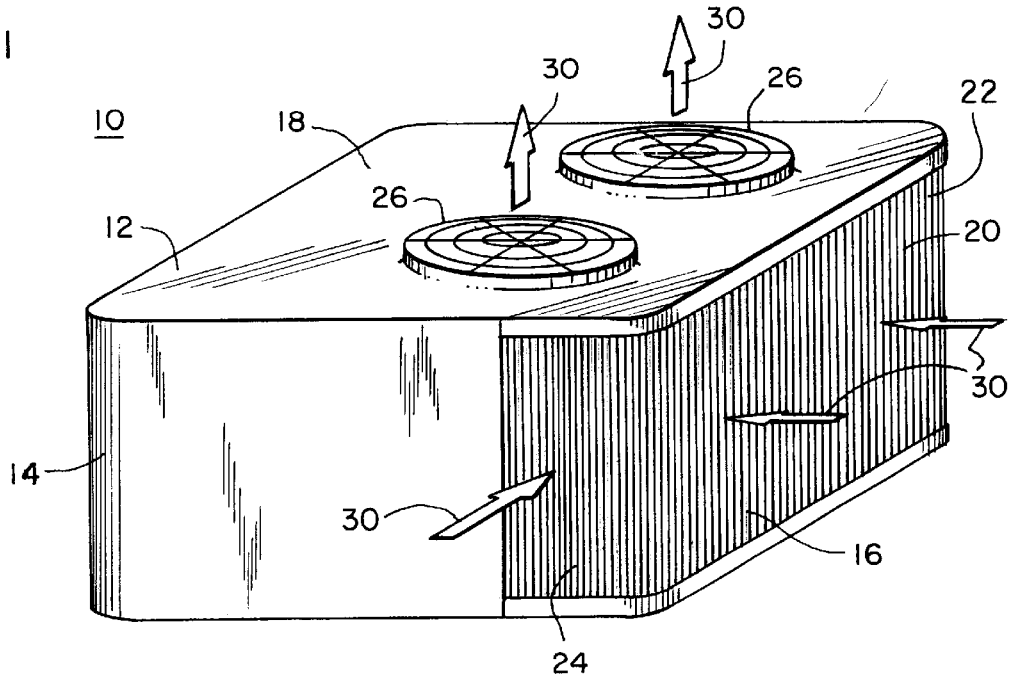
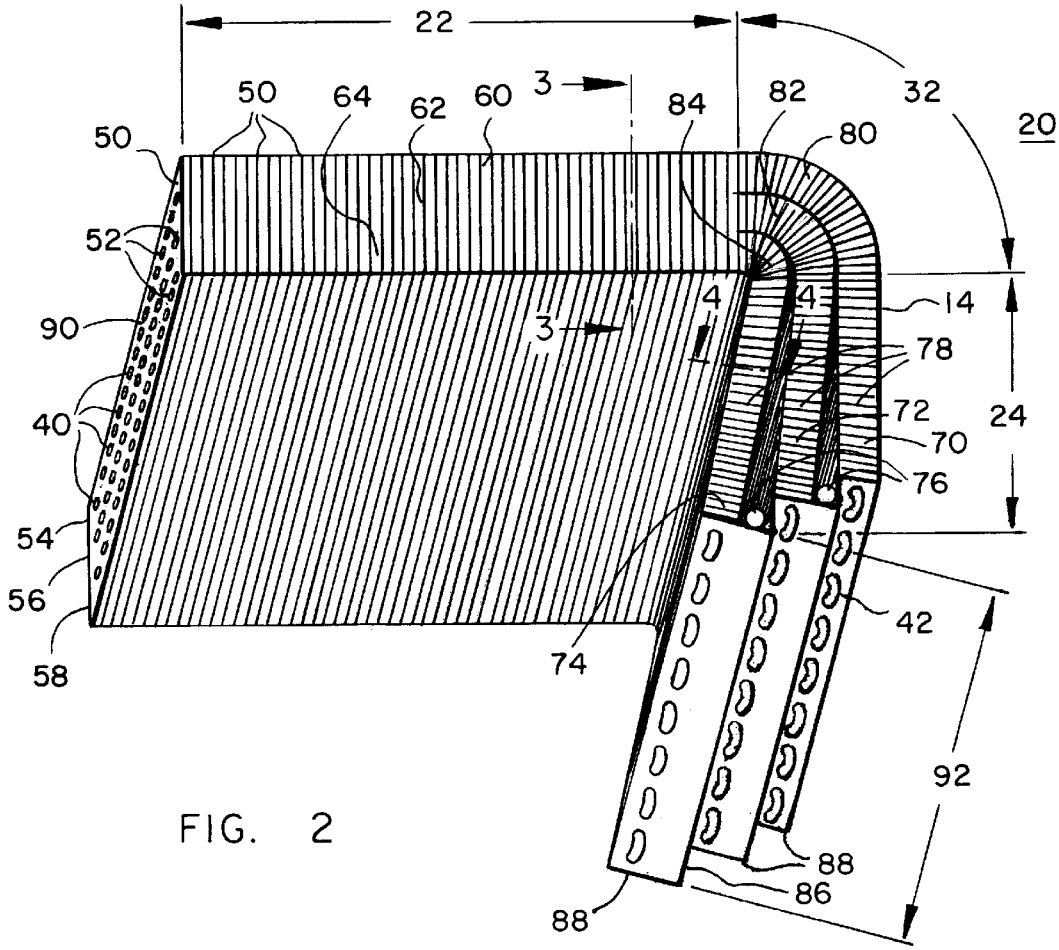
FIG. 2

FIG. 5
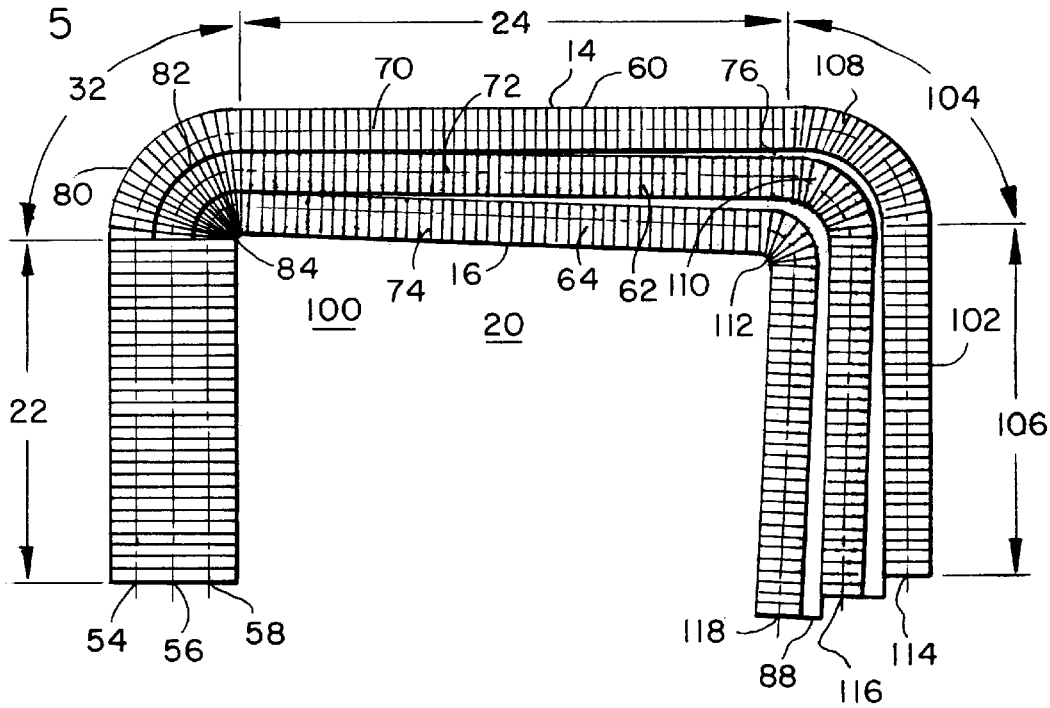
FIG. 3
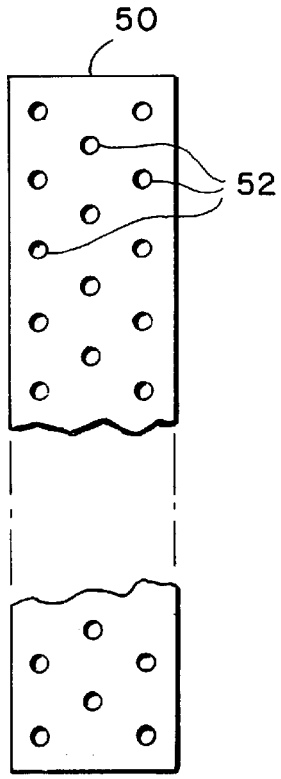
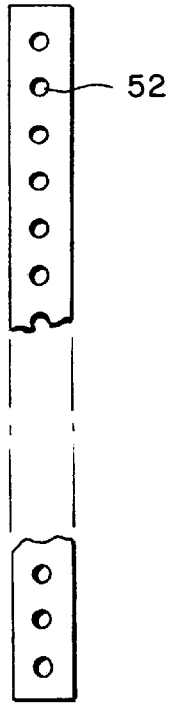
FIG. 4

FIN TUBE HEAT EXCHANGER WITH DIVERGENT TUBE ROWS

BACKGROUND OF THE INVENTION

The present invention is directed to improved heat exchange coils which avoid the collection of debris. More specifically, the improved heat exchange coils with tube rows having a boundary of some sort between adjacent tube rows are modified to avoid accumulating debris at that boundary.

Fin tube heat exchangers having a plurality of tubes running through a plurality of closely spaced plate fins are well known. When a fin tube heat exchanger is bent so that its area of operation extends to more than one side of a housing, the tube lengths in an outer row will vary with respect to the tube length in an inner row due to the increased radius of the bends traversed by the outer row. This can preclude a common plate fin from being used to engage both the tubes of the outer and inner rows at the same time. After a bend, distinct plate fins will often be used for the outer rows versus the inner rows, thus creating a boundary between the edges of the inner and outer plate fins. As airflow passes along the plate fins and around the tubes, any debris in the air will tend to accumulate at these boundary edges and potentially can block airflow through the heat exchanger, severely degrading its efficiency.

SUMMARY OF THE INVENTION

It is an object, feature and advantage of the present invention to solve the problems of the prior art.

It is an object, feature and advantage of the present invention to provide a fin tube heat exchanger with at least one bend in it where debris accumulation is minimized.

It is an object, feature and advantage of the present invention to provide a fin tube heat exchanger having a plurality of tube rows where the tube rows each include a first section in parallel, contacting relationship and a second section in diverging, non-contacting, relationship. It is a further object, feature and advantage of the present invention that the tube rows each include a bend where the radius of curvature of the bend in any particular tube row is distinctly different from the radius of curvature of a tube row bend in an adjacent tube row.

The present invention provides a fin tube heat exchanger. The heat exchanger comprises: a first tube row including a plurality of tubes, a planar slab portion and a first spread portion; and a second tube row including a second plurality of tubes, a planar slab portion and a second spread portion. The first and second tube rows include a slab portion respectively in contiguous parallel relation with the counterpart slab portion of the other tube row. The first and second spread sections are in diverging non-contacting relation with respect to each other.

The present invention also provides a fin tube heat exchanger. The fin tube heat exchanger comprises: a first tube row having a first portion, a second portion, and a third portion; and a second tube row having a fourth portion, a fifth portion and a sixth portion. The heat exchanger also comprises a first plate fin having a plurality of apertures in operative engagement with the tube rows of the first and fourth portion; a second plate fin having a plurality of apertures in engagement with the tube rows of the third portion; and a third plate fin having apertures in operative engagement with the tube rows of the sixth portion.

The present invention further provides a method of forming a heat exchanger. The method comprising the steps of: forming a first row of tubes in a first plane where each tube of the first row of tubes includes a first leg and a second leg; forming a second row of tubes in a second plane parallel to the first plane where each tube of the second tube row includes a first leg and a second leg; joining the respective first legs of the first and second tube rows with a common plate fin; providing second and third plate fins for the respective second legs of the first and second tube rows; and bending the second leg of the first tube row at a first angle such that the second leg of the first tube row is no longer in the first plane.

BRIEF DESCRIPTION OF THE DRAWINGS

FIG. 1 shows a perspective view of a housing for a heating, ventilating or air conditioning unit in accordance with the present invention.

FIG. 2 shows a perspective view of the improved heat exchange coil of the present invention.

FIG. 3 shows a plate fin associated with the slab portion of the heat exchange coil of the present invention as taken along lines 3—3 of FIG. 2.

FIG. 4 shows a plate fin associated with the spread portion of the heat exchange coil of the present invention as taken along lines 4—4 of FIG. 2.

FIG. 5 shows an alternative embodiment of a heat exchange coil of the present invention including a further spread section.

DETAILED DESCRIPTION OF THE DRAWING

The present invention, as shown in FIGS. 1–5, is directed to improved heat exchangers which avoid the accumulation of debris. The Figures are not necessarily shown to scale so as to better disclose the present invention's features.

FIG. 1 shows a packaged heat exchanger 10, including a housing 12, a side 14, an end 16 and a top 18. A fin tube heat exchanger 20 includes a planar slab portion 22 associated with the end 16 and a first spread portion 24 associated with the side 14. One or more fans 26 draw air through the heat exchanger 20 into the housing 12 so that the air and a fluid in the heat exchanger 20 are in heat exchange relationship. The path of the air is indicated by arrows 30 showing how the air is drawn through the heat exchanger 20, into the housing 12, and then expelled back to atmosphere through the fans 26.

FIG. 2 shows the heat exchanger 20 including the planar slab portion 22 and the spread portion 24. Also shown is a bend portion 32 of the heat exchanger 20 interposed between the planar portion 22 and the spread portion 24.

The planar portion 22 functions as a heat exchange slab and includes a plurality of heat exchange tubes 40 running through the planar portion 22, the bend portion 32, and the spread portion 24 to a U-bend 42. The tube 40 is turned by the u-bend 42 to return the same way that it came but displaced vertically within the row of fins.

A plurality of plate fins 50 including apertures 52 are arranged so that the apertures are in interfering engagement with the tubes 40. Each plate fin 50 is displaced slightly from the adjacent fin to provide a small space for air to flow through. Air then flows through these gaps and is placed in heat exchange relationship with a fluid such as a refrigerant passing through the tubes 40. Plate fins 50 are described in more detail in applicant's commonly assigned U.S. Pat. No. 5,056,594 to Kraay which is hereby incorporated by reference. This Kraay heat transfer surface is sold by applicant under the identifier Wavy 3BS.

In the preferred embodiment of the present invention, the heat exchanger 20 has its plurality of tubes 40 arranged in first, second and third tube rows 54, 56, 58. The individual tubes 40 in each of the first, second and third tube rows 54, 56, 58 are vertically displaced with respect to each tube in the same tube row.

Each of the first, second and third tube rows 54, 56, 58 includes slab portions 60, 62, 64 which are in planar, parallel and contiguous contacting relationship with at least one of the other slab sections 60, 62, 64. Each of the tube rows 54, 56, 58 also includes a respective spread section or leg 70, 72, 74 associated with the spread portion 24 where the spread section 70, 72, 74 are in non-contacting, diverging relation. In other words, the spread sections 70, 72, 74 are separated relative to each other by gaps 76. The spread sections 70, 72, 74 each include individual plate fins 78 which are specific to one of the first, second or third tube rows but which are separated from plate fins 78 in a similar plane in an adjacent section 70, 72, 74 by the gaps 76.

Each of the first, second and third tube rows 54, 56, 58 includes a respective bend 80, 82, 84. The radius of curvature of the first tube row's bend 80 is different than the radius of curvature of the second tube row's bend 82 which are both different than the radius of curvature of the third tube row's bend 84. Preferably, the outermost bend angle, that of bend 80, is approximately 90° for ease of manufacturing and to result in a generally rectangular housing 12 but under other circumstances can be 45° or 135° or anything therebetween. The tubes 40 in the first tube row 54 travel a greater distance in the bend 80 than the tubes 40 in the second and third tube rows 56 and 58 and therefore have a shorter length in the spread portion 24. Similarly, the tubes 40 in the second tube row 56 travel a greater distance in the bend 82 than the tubes 40 in the third tube row 58 and therefore have a shorter length in the spread portion 24. This difference in length is due to the differing radius of curvature of the bends 80, 82, 84 and the fact that the tubes 40 are of the same length. An end wall 86 is provided to block off airflow between the ends 88 of the first, second and third tube rows 54, 56, 58 and to position and protect those ends 88.

Alternatively but not shown, the first, second and third tube rows may each start at a respective plane 90 and may each end approximately at the same plane 92. To accomplish this, the length of the tubes 40 in the first tube row 54 may be made greater than the length of the tubes 40 in the second row 56. In turn, the length of the tubes 40 in the second tube row may be made greater than the length of the tubes 40 in the third tube row 58.

FIG. 5 shows an alternative embodiment of the present invention 100 wherein the heat exchange coil 20 extends on a further side 102 of the housing 12. In this second alternative embodiment, like reference numerals are used to illustrate like elements. Essentially, each of the tube rows is extended by a further bend section 104 including bends 108, 110, 112 in respective first, second and third tube rows 54, 56 and 58, and a second spread section 106 including legs 114, 116, 118 in respective first, second and third tube rows 54, 56, 58.

What is shown is a heat exchange coil including fin and tube rows where the final section of the tube rows are vertically divided into diverging non-contacting tube rows. Clearly the number of tube rows, the positioning of the apertures, the shapes of the tubes in the apertures, the angles of divergence, and the heat exchange properties of the plate fins could be varied extensively by a person of ordinary skill in the art. All such modifications are intended to fall within the spirit and scope of the claimed invention.

What is desired to be secured by Letters Patent of the United States is set forth in the following claims.

What is claimed is:

1. A fin tube heat exchanger comprising:

a first tube row having a first portion, a second portion, and a third portion;

a second tube row having a fourth portion, a fifth portion and a sixth portion;

a first plate fin, having a plurality of apertures, in operative engagement with the tube rows of the first and fourth portions;

a second plate fin, having a plurality of apertures, in engagement with the tube rows of the third portion;

a third plate fin, having a plurality of apertures, in operative engagement with the tube row of the sixth portion;

wherein a third portion is a first angle relative to the first portion and the sixth portion is at a second angle relative to the first portion; and wherein first and second angles diverge.

2. The heat exchanger of claim 1 wherein the second and third plate fins are separated by a gap.

3. The heat exchanger of claim 2 wherein the second portion includes a first bend having a first curvature and wherein the fifth portion has a second bend including a second curvature.

4. The heat exchanger of claim 3 wherein the first curvature differs from the second curvature.

5. The heat exchanger of claim 4 wherein the first portion and the fourth portion lie in parallel planes.

6. The heat exchanger of claim 5 wherein the first set of tubes has a length which is longer than the length of the second set of tube rows.

7. The heat exchanger of claim 5 wherein the first set of tubes has a length which is substantially the same as the length of the second set of tubes.

8. The heat exchanger of claim 7 wherein each set of tubes has an end joined by an end wall.

9. A fluid-to-fluid heat exchanger comprising:

a plurality of tubes containing a heat transfer fluid, each tube of the plurality of tubes having a first leg and a second leg, the plurality of tubes including a first set of the plurality of tubes, and a second set of the plurality of tubes;

a first wall structure including the first legs of the first set and the first legs of the second set;

a second wall structure including the second legs of the first set;

a third wall structure including the second legs of the second set;

wherein the first legs of each tube in the first wall structure are in parallel; and wherein the second legs in the second wall structure are at divergent angles in relation to the second legs in the third wall structure.

10. The heat exchanger of claim 9 including a plurality of first plate fins, each first plate fin including a plurality of apertures, each of the first plate fins being in interfering relation with first legs of the plurality of tubes.

11. The heat exchanger of claim 10 including a plurality of second plate fins, each second plate fin including a plurality of apertures, each of the second plate fins being in interfering relationship with the second legs of the second wall structures.

12. The heat exchanger of claim 11 further including a plurality of third plate fins, each third plate fin including a plurality of apertures, each of the third plate fins being in interfering relationship with the second legs of the third wall structure.

13. A fin tube heat exchanger comprising:

a first tube row including a plurality of tubes, a slab portion and a first spread portion;

a second tube row including a second plurality of tubes, a slab portion and a second spread portion;

wherein each of the first and second tube rows slab portions are respectively in contiguous parallel relation with the counterpart slab portion of the other tube row; and wherein the first and second spread sections are in diverging non-contacting relation with respect to each other.

14. The fin tube heat exchanger of claim 1 wherein the slab portion of the first tube row is separated from the first spread section of the first tube row by a first bend; and wherein the slab portion of the second tube row is separated from the second spread section of the second tube row by a second bend.

15. The fin tube heat exchanger of claim 14 wherein the radius of curvature of the first bend differs from the radius of curvature of the second bend.

16. The fin tube heat exchanger of claim 15 wherein each of the slab portion is planar.

17. The fin tube heat exchanger of claim 13 wherein the plurality of tubes in the first tube row have a length which is greater than the plurality of tubes in the second tube row.

18. The fin tube heat exchanger of claim 13 wherein the plurality of tubes in the first tube row have substantially the same length as the plurality of tubes in the second tube row.

19. The fin tube heat exchanger of claim 13 wherein the first and second spread sections each have an end joined by an end wall.

20. The fin tube heat exchanger of claim 13 wherein each of the slab portions is planar.

21. A method of forming a heat exchanger comprising the steps of:

forming a first row of tubes in a first plane where each tube of the first row of tubes includes a first leg and a second leg;

forming a second row of tubes in a second plane parallel to the first plane where each tube of the second tube row includes a first leg and a second leg;

joining the respective first legs of the first and second tube rows with a common plate fin;

providing second and third plate fins for the respective second legs of the first and second tube rows;

bending the second leg of the first tube row at a first angle such that the second leg of the first tube row is no longer in the first plane; and bending the second leg of the second tube row to a second angle such that the second leg is not in the second plane and the second angle differs from the first angle.

22. The method of claim 21 including joining an end wall between an end portion of the second leg of the first tube row and an end portion of the second leg of the second tube row.

23. The method of claim 21 wherein the first tube row includes a first bend portion linking the first and second leg and the second tube row includes a second bend portion linking its first and second leg and wherein the first bend portion of the first tube row has a different radius of curvature than the second bend portion of the second tube row.

24. The method of claim 21 wherein at least one of the first or second angles is approximately 45° or 90° or 135°.

25. The method of claim 21 wherein the first angle is about 90°.

* * * * *

UNITED STATES PATENT AND TRADEMARK OFFICE

CERTIFICATE OF CORRECTION

PATENT NO. : 6,672,375 B1 
DATED : January 6, 2004
INVENTOR(S) : Glen F. Shippy, Jeffrey C. Marks and Allen Swaw It is certified that error appears in the above-identified patent and that said Letters Patent is hereby corrected as shown below:

Column 5,
Line 21, "claim 1" should read -- claim 13 --.

Signed and Sealed this

Twenty-fifth Day of May, 2004

JON W. DUDAS
*Acting Director of the United States Patent and Trademark Office*